United States Patent [19]

Gehrke

[11] Patent Number: 4,515,309

[45] Date of Patent: May 7, 1985

[54] RAIL FASTENER ASSEMBLY AND COMPONENTS THEREOF

[75] Inventor: Erich F. Gehrke, Krugersdorp, South Africa

[73] Assignee: BTR South Africa Limited, Randburg, South Africa

[21] Appl. No.: 372,832

[22] Filed: Apr. 28, 1982

[30] Foreign Application Priority Data

Apr. 29, 1981 [ZA] South Africa ..... 81/2832

[51] Int. Cl.[3] ..... E01B 9/28

[52] U.S. Cl. ..... 238/349; 238/351

[58] Field of Search ..... 238/349, 350, 351, 338, 238/310, 315

[56] References Cited

U.S. PATENT DOCUMENTS 3,065,914 11/1962 Rigby ..... 238/351

FOREIGN PATENT DOCUMENTS 226704 2/1960 Australia ..... 238/349
267088 9/1963 Australia .
86036 8/1955 Norway ..... 238/349

OTHER PUBLICATIONS

Brochure entitled, "FIST-BTR"-no date.

*Primary Examiner*—Robert B. Reeves
*Assistant Examiner*—Donald T. Hajec
*Attorney, Agent, or Firm*—Cushman, Darby & Cushman

[57] ABSTRACT

A rail fastening assembly and sleepers and spring clips for use in such an assembly are provided by the invention. The assembly includes a sleeper having rail locating recesses in its operatively upper surface and sockets in the sides thereof and extending in the general direction of a rail supported thereon. Spring clips of a generally arcuate shape have a spigot received within an associated socket and a rail engaging formation at its other end. Each spring clip is thus enclosed in its socket and held under tension in the operative position such that the rail is held firmly onto the sleeper. The sockets are located on or inside of a line at right angles to the rail foot surface with which the clip co-operates such that the clip must be placed in further tension to release it and the tendency is for it to move in a direction favoring tighter engagement with the rail.

13 Claims, 4 Drawing Figures

RAIL FASTENER ASSEMBLY AND COMPONENTS THEREOF

BACKGROUND OF THE INVENTION

This invention relates to a rail fastener assembly and the component parts thereof, and more particularly, to a rail fastener assembly embodying shaped spring steel fastener elements for bearing on a rail foot or flange.

Still more particularly but not exclusively, the invention is directed at providing a low cost rail fastener assembly which can be employed on relatively light duty and narrow gauge types of rail tracks. It must, however, be understood that the application of the invention is not to be interpreted as being limited in any way to such low cost types of applications and the invention is equally applicable to conventional full scale rail tracks.

Often used for the purpose of securing a rail to a sleeper are the well known rail spikes. Such spikes are received in a hole in the sleeper and are generally maintained there solely by frictional forces. Consequently such rail spike type fasteners can work loose under load and in consequence of vibrations and also the clamping force on the rail foot or flange is not constant. The hole can also be clogged with dirt and moisture which is extremely inconvenient.

Many other systems of rail fasteners exist and, at least for the most part, these include ferrous components partially embedded in the sleeper. Such ferrous components are adapted to receive and hold down a fastening element which bears on the rail foot or flange. The disadvantages of this type of system is that the partially embedded components corrode easily and, since they extend out of the top surface of the rail, they may be damaged easily during transportation, installation or train derailments. Any damage partially embedded components requires that the entire sleeper be replaced although the sleeper itself is not damaged or corroded. Furthermore, the location of projecting parts of partly embedded components gives rise to inconvenience and difficulties with regard to stacking and additional space is usually required because of the care which is necessary in effecting such stacking. Spacers may additionally be necessary.

One form of rail fastener assembly which does not suffer from the above disadvantages is of our own manufacture and sold under the Trade Name "FIST" fastener. This fastener comprises a pin passing transversely through a sleeper directly beneath a rail and with which cooperates a sinuous and somewhat large spring steel fastener which has its two free ends bearing on one rail foot or flange and a central area bearing on the opposite rail foot or flange with two portions of the spring steel passing beneath the pin. This system operates effectively but is somewhat costly for many applications.

It is accordingly the object of this invention to provide a rail fastener assembly and components thereof which is less costly than our so-called "FIST" fastener but which has the same advantageous features at least to a large extent.

SUMMARY OF THE INVENTION

In accordance with this invention there is provided a rail fastener assembly comprising a sleeper having positions spaced apart along its length for receiving transversely extending rails, two transverse sockets extending into the sides of the sleeper at positions spaced downwardly from the upper support surface thereof and wherein the sockets are each located beneath the portion of the sleeper adapted to support a rail foot or flange in use such that the axis of each socket is located on or inwardly of, a line extending at right angles to the upper surface of the appropriate rail flange or side of the rail foot, a spring clip for each socket and having a spigot end received within the associated socket and a shaped region adopted to bear on the upper surface of the rail foot or flange above the socket and wherein the interconnecting length of spring steel is shaped to provide a required degree of resilience.

Further features of the invention provide for the sleeper to have transverse rail locating recesses in the regions for receiving the rail feet or flanges or rail pad associated therewith, for said recesses to be dimensioned to accommodate a rail pad preferably of insulating material positioned between the surface of the recess and the rail foot or flange; for the socket to be defined by a liner positioned within the body of the sleeper; for the rail clips associated with the two flanges or opposite sides of a single rail to co-operate with sockets in opposite sides of the sleeper; and for the sleeper to be made of cast cementitious material in which socket defining members are embedded during manufacture.

The invention also provides spring clips and sleepers particularly adapted for use in a rail fastener assembly as described above.

It will be understood that if the rails are to be electrically insulated from the sleeper, suitable insulators could be positioned between the shaped end of the spring clip which co-operates with the rail foot or flange and the flange or foot itself or, alternatively, a suitable insulator could be positioned between the sleeve and spigot end of the spring clip. Many different possible arangements of this part of the construction are possible. The liner could itself be of insulating material moulded into the concrete or it could be a metal liner moulded into the concrete. A sleeve could, where required, be introduced into each liner. In fact the liner could be omitted and either no sleeve or a required sleeve fitted into the hole which may be blind or pass through the sleeper. Similarly the sleeves and liners may be of a blind configuration or open at their inner ends. The spring clip may also be totally enclosed within a sheath of insulating material which could have the additional advantage of providing a corrosion resistant coating or sheath.

It is to be clearly understood that whilst the entire rail fastening assembly has been defined above, this has only been done by way of convenience and clarity and the invention includes within its scope the individual component parts of the rail fastening assembly irrespective of whether or not they are in combination with other co-operating parts. Thus, sleepers made to receive spring clips to form a fastening assembly as above defined are intended to be protected independently of the spring clip and likewise the spring clips are intended to be protected irrespective and separately from the sleepers.

BRIEF DESCRIPTION OF THE DRAWINGS

In order that the invention may be more fully understood, one embodiment thereof, and one variation thereof, will now be described with reference to the accompanying drawings in which.

DETAILED DESCRIPTION WITH REFERENCE TO THE DRAWINGS

Figure 1:
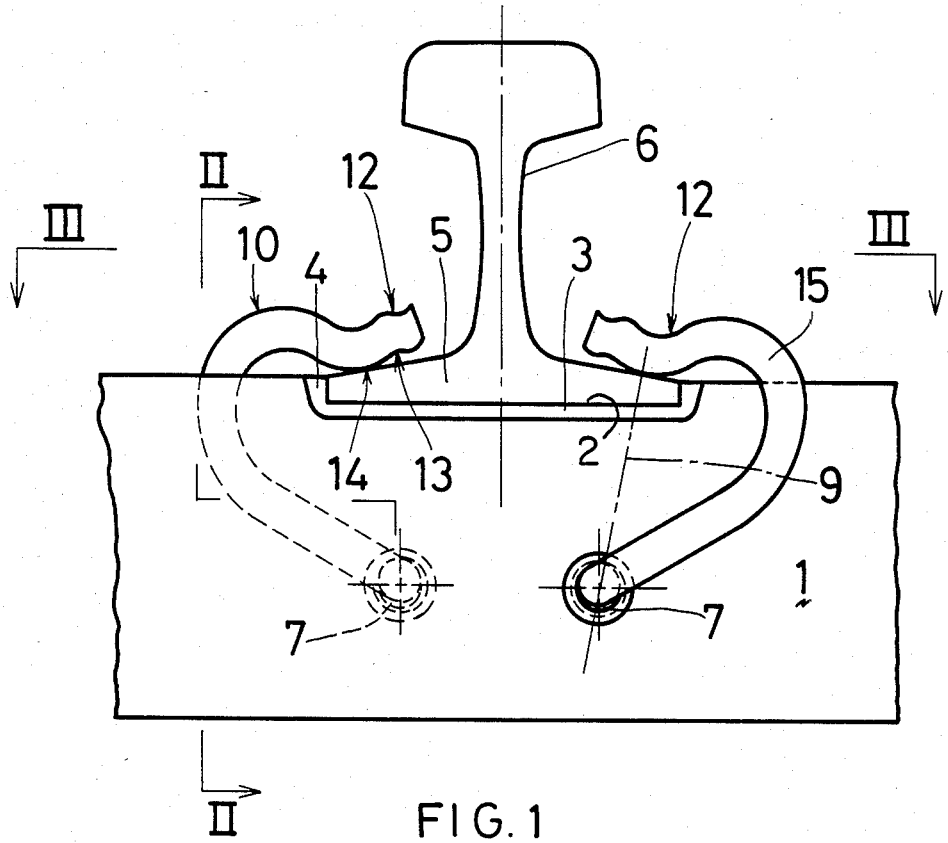
FIG. 1 is a cross-section taken through a rail supported on a sleeper and fastened thereto according to the invention.
Figure 2:
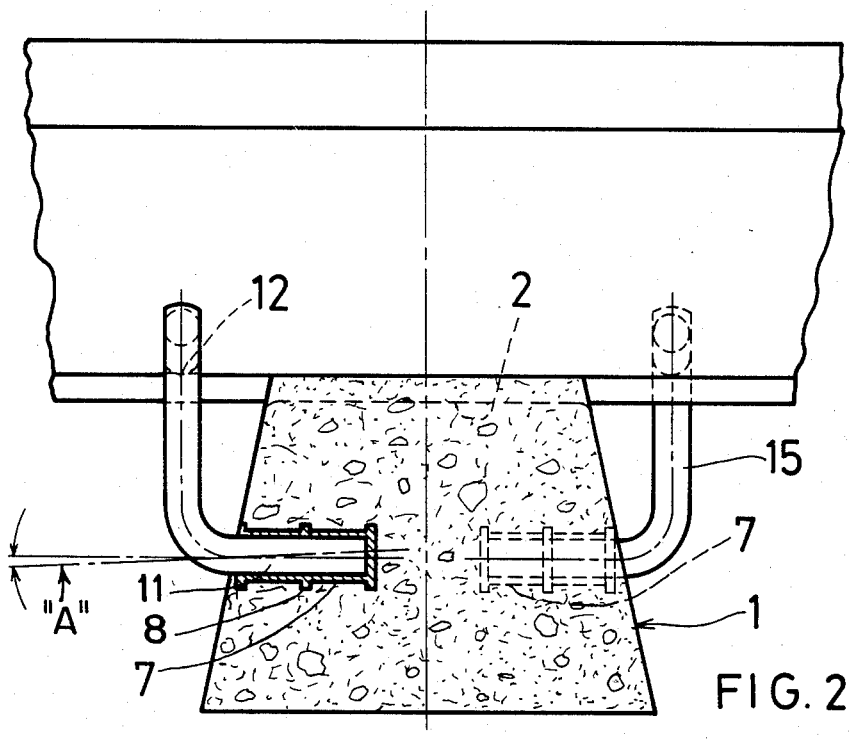
FIG. 2 is a sectional view taken along line II to II in FIG. 1.
Figure 3:
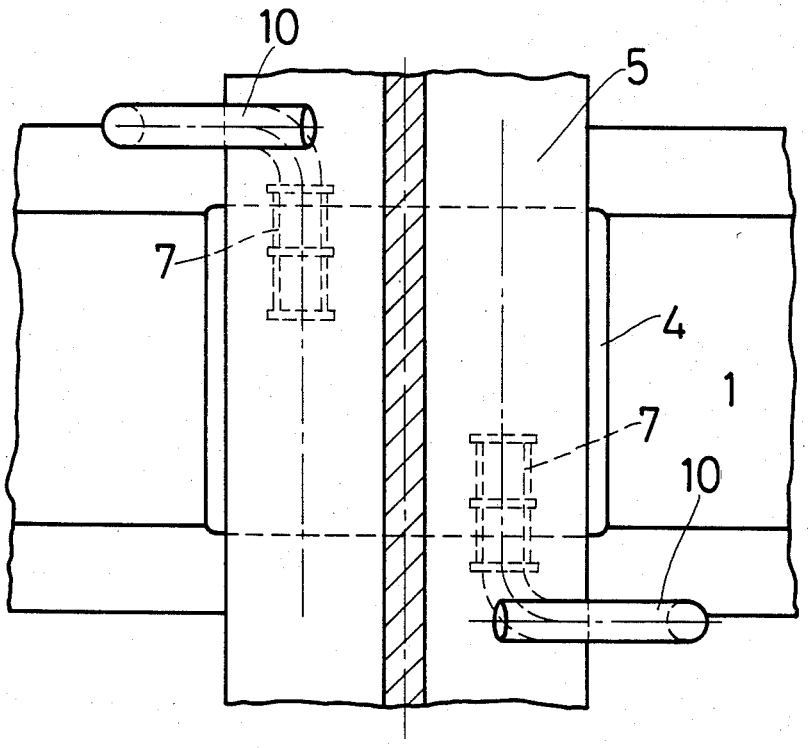
FIG. 3 is a sectional plan view taken along line III to III in FIG. 1.

As illustrated in FIGS. 1 to 3 a sleeper 1, in this case made of cast cementitious material, has two spaced recesses 2 cast in the upper surface thereof so as to receive, in the operative position, an insulating base plate 3. The base plate 3 may, in fact, be absent if required and may also not be of insulating material if this characteristic is not required. The shoulder regions 4 of the base plate which serve to locate the foot 5 of a rail 6 could be of unequal width to enable the rails to be positioned at different spacings according to the orientation of the base plate.

In either event the base plate is adapted to locate the rail foot 5 properly along the length of the sleeper and the sleeper has in its side faces sockets 7, in this case defined by sleeves. The sleeves preferably have a blind end and are of insulating material and have circumferentially extending formations 8 on their outer surfaces to ensure good contact with the concrete.

The sockets are each located on a line extending at right angles to the upper surface of the associated rail flange with such line being positioned inwardly of the edge of the rail flange as shown clearly in FIG. 1 by line 9. In this manner two sockets are provided beneath each recess 2 and conveniently one socket extends in from each of the two sides faces of the sleeper. In this way, as shown clearly in FIG. 3, one rail clip 10 co-operates with the rail foot on each side of the sleeper. It is also within the scope of this invention to provide four spring clips for each rail flange in which case the sockets could be blind or, could in fact, be constituted by the two ends of a hole passing through the sleeper. Also the two sockets could be located directly beneath the centreline of the rail in which case they could again both be blind or form the two ends of a hole through the sleeper.

The axis of each socket may extend parallel to the rail foot in use but may conveniently be inclined downwardly from its inner end, as indicated by the dash-dot line "A" in FIG. 2 so that moisture and dirt do not tend to run up the incline into the socket. Also such an incline inhibits automatic working loose of the clip since as the clip moves laterally it will clamp more tightly onto the rail as will be more clearly described hereinafter.

A rail clip 10 co-operates with each of the sockets and has a spigot portion 11 located in each socket. A shaped operative end 12 bears on the upper surface of the rail foot, usually on a line at right angles to said surface and which is co-planar with the axis of the socket and outside of the surface portion of the sleeper on which the rail 6 is supported. However, it will be understood that the socket axis could be located somewhat inwardly relative to such position if required, so long as the tendency of the rail clip to disengage the flange leads to a tightening of the resilient force exerted thereon. The shaping of this end includes a recessed zone 13 immediately on the outside of a convex oad bearing zone 14. The recessed zone is adapted to receive the edge of the rail foot during hand installation of the clips and hold the clip temporarily relative to the rail in readiness for final installation during which the clip is placed in tension. Such final installation may be effected by means of either a hammer or a tensioning tool.

The portion 15 between the rail engaging end region 12 and the spigot portion 11 of each rail clip is simply shaped to an arcuate configuration so as to provide a desired resilient force exerted on the foot of the rail. In the case illustrated in FIGS. 1 to 3 this intervening portion is simply co-planar with the operative end portion 12 and in a plane at right angles to the spigot and is of a simple curved configuration.

Figure 4:
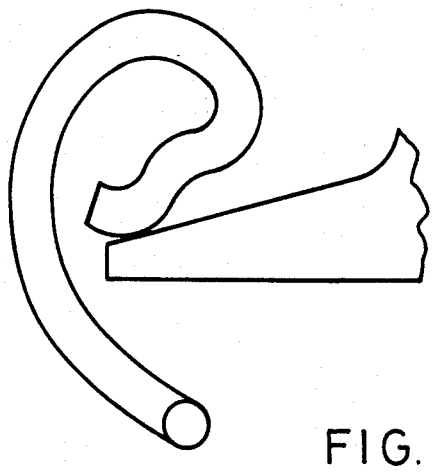
FIG. 4 illustrates in side elevation an alternative shape of the spring clip which could be employed.

As illustrated in FIG. 4 the clip could pass through a greater radius of curvature in order to provide a greater degree of resilience bearing downwardly on the rail foot.

In order to locate a rail clip in its operative position the spigot end is simply introduced into the socket and the clip is rotated so that it starts to engage the rail flange. The clip can then be driven or squeezed into its operative position as may be required.

It will be understood that numerous variations may be made to the above described embodiment of the invention without departing from the scope hereof. In particular, the sleeper may be made from plastics material or even wood or steel provided the sockets are positioned in the side faces thereof as described above. The spring clips, which are simply made from bent lengths of circular cross-sectioned rod suitably heat treated after forming could be replaced by clips of other configurations and other cross-sectional shapes. Also the planes in which the operative parts of the spring clips are located could be inclined to the spigot portions of the clips in particular to cause the operative end region of the clip to engage the rail flange at a position nearer the centre of the sleeper. Clearly the sockets need not be lined at all or they may have sleeves therein which are non-insulating where the insulating feature is not required. Alternatively insulators could be introduced between the operative end of a spring clip and the rail flange.

It will be understood that the invention provides a simple and effective rail fastening assembly whereof the components can be easily and inexpensively manufactured and the sleepers can be stacked for storage or transport without endangering any protruding portions of partially embedded parts of the fastening assembly. Also, the sleeper need have no corrodeable parts partially or wholly embedded therein.

It will therefore be understood that the invention provides a simple and useful rail fastening assembly and component parts thereof.

What I claim as new and desire to secure by Letters Patent is:

1. A rail fastener assembly comprising a sleeper having an upper support surface defining a bearing zone for receiving transversely extending rails, two transverse sockets extending from an outer end thereof to an inner end thereof into the sides of the sleeper at positions spaced downwardly from the upper support surface thereof, and wherein the sockets are each located beneath the portion of the sleeper supporting said rail such that the axis of each socket is located inwardly of a line extending at right angles to the upper surface within the bearing zone on the appropriate rail flange of the rail foot adjacent its outer extremity, a spring clip co-operating with each socket and having a spigot end rotatably received within the associated socket and a shaped region connected to said spigot end by an interconnecting length, said shaped region adapted to bear on the upper surface of the rail foot above the socket and outside the upper surface of said sleeper in which said rail is supported and wherein the interconnecting length of spring steel is of arcuate shape and designed to provide a required degree of resilience, said spring clip being rotatable about the axis of said spigot end between operative and inoperative positions.

2. A rail fastener assembly as claimed in claim 1 in which the sleeper has transverse rail locating recesses for receiving the rail flanges.

3. A rail fastener assembly as claimed in claim 1 in which an electrically insulating rail pad is interposed between each rail and the sleeper.

4. A rail fastener assembly as claimed in claim 1 in which each socket has its axis extending in a direction substantially parallel to an axis of the rail.

5. A rail fastener assembly as claimed in claim 4 in which the socket has an inner end and an outer opening and wherein the axis of the socket is inclined somewhat downwardly from its inner end to its outer opening.

6. A rail fastener assembly as claimed in claim 1 in which the socket is, in each case, provided with a liner moulded into the sleeper.

7. A rail fastener assembly as claimed in claim 1 in which a sleeve of electrically insulating material is located between the spigot and socket to electrically insulate the spring clip from the sleeper.

8. A rail fastener assembly as claimed in claim 1 in which the rail clips bearing on the two opposite flanges of the same rail co-operate with sockets in opposite sides of the sleeper.

9. A rail fastener assembly as claimed in claim 1 in which the sleeper is made of a cast cementitious material.

10. A rail hold down system comprising rail support means for supporting the rail, said rail support means having means defining rail locating portions for locating a transversely extending rail, a pair of transversely extending sockets positioned within said rail support means so that each socket with said pair lies beneath said rail, and spring clip means for engaging both said rail and said rail support means to hold said rail in place, said spring clip means having a first rail support means engaging end for extending into one of said sockets and a second rail engaging portion for engaging the rail beyond said rail locating portions, said first rail support means engaging end being rotatably retained so that said spring clip means is rotatable relative to both said rail and rail support means between operative and inoperative positions.

11. A rail hold down system as in claim 10, wherein said second rail engaging portion includes an outer end, means defining a shaped recess opening toward said outer end for initially fitting over a portion of said rail and means defining a bearing for applying a retaining load on said rail, said bearing means being spaced inwardly from said shaped recess means.

12. A rail hold down system as in claim 11, wherein said first rail support means engaging end is angled in a direction substantially normal to said second rail engaging portion.

13. A rail hold down system as in claim 11, wherein said each of said sockets is positioned at least on a line normal to the point where the retaining load is applied to said rail.

* * * * *